US007896712B2

(12) United States Patent
Cecil et al.

(10) Patent No.: US 7,896,712 B2
(45) Date of Patent: Mar. 1, 2011

(54) INTEGRAL BONDING ATTACHMENT

(75) Inventors: David Charles Cecil, Saint Augustine, FL (US); Jack Edgar Sutherland, Saint Augustine, FL (US)

(73) Assignee: Tensolite, LLC, St. Augustine, FL (US)

( * ) Notice: Subject to any disclaimer, the term of this patent is extended or adjusted under 35 U.S.C. 154(b) by 1075 days.

(21) Appl. No.: 11/613,844

(22) Filed: Dec. 20, 2006

(65) Prior Publication Data

US 2010/0130072 A1 May 27, 2010

Related U.S. Application Data

(63) Continuation-in-part of application No. 11/315,456, filed on Dec. 22, 2005, now Pat. No. 7,241,185.

(51) Int. Cl.
*H01R 4/18* (2006.01)

(52) U.S. Cl. ..... 439/730; 439/523; 439/932; 439/741; 439/877; 439/883; 439/878; 439/810; 439/880; 439/882

(58) Field of Classification Search ..... 439/730, 439/741, 523, 932, 877, 878, 882, 883, 801, 439/810, 880, 97; 174/87, 84 R, 84 C
See application file for complete search history.

(56) References Cited

U.S. PATENT DOCUMENTS

| | | | | |
|---|---|---|---|---|
| 2,804,602 | A | 8/1957 | Vizcarrondo | |
| 2,807,792 | A * | 9/1957 | O'Keefe et al. | 439/730 |
| 2,901,722 | A * | 8/1959 | Arnott, Jr. | 439/203 |
| 3,281,524 | A | 10/1966 | Lynch, Jr. et al. | |
| 3,291,894 | A | 12/1966 | Sampson | |
| 3,601,783 | A | 8/1971 | Loose | |
| 3,619,481 | A | 11/1971 | Smith | |
| 3,805,221 | A | 4/1974 | Kuo | |
| 3,955,044 | A * | 5/1976 | Hoffman et al. | 174/84 C |
| 3,956,823 | A | 5/1976 | Kuo | |
| 4,072,041 | A | 2/1978 | Hoffman et al. | |
| 4,578,088 | A | 3/1986 | Linscheid | |
| 4,584,429 | A | 4/1986 | Raketti et al. | |
| 4,631,631 | A | 12/1986 | Hodges et al. | |

(Continued)

FOREIGN PATENT DOCUMENTS

| | | |
|---|---|---|
| JP | 05049114 | 2/1993 |

OTHER PUBLICATIONS

Eight-page International Search Report and Written Opinion from Counterpart International Application No. PCT/US2006/048871, now Publication now WO2007/075934, published Jul. 5, 2007.

*Primary Examiner*—Tho D Ta
(74) *Attorney, Agent, or Firm*—Wood, Herron & Evans, LLP

(57) ABSTRACT

An integral bonding attachment includes an insulated section of a conductive wire with an exposed, uninsulated section. A sleeve covers the insulated and uninsulated sections of the conductive wire, and the sleeve includes a flattened section encasing at least a portion of the uninsulated wire section to form a generally integral structure with the core of the conductive wire. At least one generally tubular section is positioned at an end of the flattened section to engage the insulated section of the conductive wire. An aperture may pass simultaneously through the inner core and flattened sleeve section for attaching the integral bonding attachment to a structure.

24 Claims, 7 Drawing Sheets

U.S. PATENT DOCUMENTS 4,666,227 A 5/1987 Galizia et al.
4,677,255 A 6/1987 Cumley
4,693,688 A 9/1987 Cembruch et al.
4,698,456 A 10/1987 Hamacher
4,703,221 A 10/1987 Ochoa et al.
4,717,354 A 1/1988 McCleerey
4,737,601 A 4/1988 Gartzke
4,772,231 A 9/1988 Hayes
4,840,585 A 6/1989 Muzslay
4,895,534 A 1/1990 Klunk et al.
4,965,409 A 10/1990 Lindroos
5,033,187 A 7/1991 Gloe et al.
5,106,319 A 4/1992 Julian
5,106,329 A 4/1992 Maeshima et al.
5,135,418 A 8/1992 Hatagishi et al.
5,181,867 A 1/1993 Rodondi et al.
5,263,880 A 11/1993 Schwarz et al.
5,350,316 A 9/1994 Van Wagener et al.
5,407,371 A 4/1995 Chen
5,413,509 A 5/1995 Castaldo
5,499,448 A * 3/1996 Tournier et al. ..... 29/863
5,548,089 A 8/1996 Yamat
5,613,885 A 3/1997 Plate et al.
5,662,503 A 9/1997 Castaldo
5,722,991 A 3/1998 Colligan
5,762,509 A 6/1998 Kang
5,762,526 A 6/1998 Kuramoto et al.
5,823,833 A 10/1998 Castaldo
5,879,181 A 3/1999 Okabe
5,929,373 A 7/1999 Schiavo et al.
5,938,487 A 8/1999 Henry et al.
6,033,255 A 3/2000 Murofushi
6,066,007 A 5/2000 Huang
6,132,264 A 10/2000 Egenolf
6,257,920 B1 7/2001 Finona et al.
6,305,975 B1 10/2001 Steiner
6,331,742 B1 12/2001 Renkes et al.
6,338,637 B1 1/2002 Muench, Jr. et al.
6,369,474 B1 4/2002 Tanaka et al.
6,500,032 B2 12/2002 Endo et al.
6,517,366 B2 2/2003 Bertini et al.
D475,022 S 5/2003 Kihira et al.
6,604,403 B1 8/2003 Eslambolchi et al.
6,672,910 B2 1/2004 Hotea
6,753,475 B2 6/2004 Takahashi et al.
6,812,404 B1 11/2004 Martinez
6,843,685 B1 1/2005 Borgstrom et al.
6,905,376 B2 6/2005 Chen
6,929,492 B2 8/2005 Bertini et al.
6,976,889 B2 12/2005 Kuwayama et al.
7,174,633 B2 * 2/2007 Onuma ..... 29/854
7,479,316 B2 * 1/2009 Duke et al. ..... 428/36.91
2002/0142677 A1 10/2002 Hosaka et al.

* cited by examiner

INTEGRAL BONDING ATTACHMENT

RELATED APPLICATIONS

This application is a continuation-in-part application of U.S. patent application Ser. No. 11/315,456 filed Dec. 22, 2005 and entitled "Integral Bonding Attachment", which application is completely incorporated herein by reference.

TECHNICAL FIELD OF THE INVENTION

The present invention is directed to devices for connecting and securing a conductor or wire to a support structure, and particularly, but not exclusively, to an integral bonding attachment for connecting a conductive wire to a support surface in the construction of an aircraft.

BACKGROUND OF THE INVENTION

During the construction of many different structures, such as airplanes, it is necessary to provide suitable grounding for the electronics and electrical systems. It is particularly critical for airplane construction, because airplanes, in addition to requiring a robust ground reference for their electrical systems, are also subject to outside electrical phenomenon, such as lighting and stray electromagnetic energy (EME), such as from radars or the like. In the past, the metallic wing structure of an airplane provided a grounding system and overall attachment point for ground references. However, with the advent and growing popularity of composite wing structures, it has been necessary to provide an alternate grounding system.

Currently, the airplane frame is used to provide a grounding reference and an attachment point for various ground busses in the electrical system of the aircraft. The most common method for making such a connection is to use a lug. A lug is a device having an open end or sleeve for receiving an end of a tubular wire or other conductor. The other end is a flattened portion with a hole to connect the lug to a flat surface. The sleeve of the lug is slid over the end of the tubular conductor and then a crimping pliers, an adhesive, welding, or other similar techniques are used to connect the lug to the conductor. The lug is thus attached to the conductor and the flat end is positioned to rest upon the flat surface of a frame portion or other support structure. The hole in the flat surface enables a fastener or bolt to pass through to firmly fix the tubular structure to the flat surface.

Traditional lugs have many drawbacks. First, a weakness exists between the conductor cable and the open end or sleeve of the lug. For example, the conductor may pull out of the lug. Furthermore, the stress on the conductor at the crimp might cause the conductor to break at that point. Additionally, potential for less than optimal performance exists. Oftentimes, the lug is made of a different metal than the conductor and corrosion may occur between the dissimilar metals. Furthermore, the lug-to-cable interface is often subject to corrosion due to moisture. This may lead to premature corrosion failure of the cable. Also, the crimped lug may not provide a good low resistance or low impedance path through the end of the conductor. Still further, for attachment of the lugs along a long length of cable, it is necessary to cut the cable, attach two lugs to the cut end, and then bolt the two lugs to the frame or other structural element. As may be appreciated, such additional steps are time consuming and costly. Also, as may be appreciated, it is undesirable to provide a break or cut in the length of the cable.

Therefore, many needs exist in this area of technology, particularly with respect to providing a robust ground reference in an airplane.

SUMMARY OF THE INVENTION

One embodiment of the invention includes an integral bonding attachment for connecting a conductive wire to an attachment surface, such as a grounding surface. The integral bonding attachment includes an insulated section of the conductive wire, an uninsulated section of the conductive wire integrally formed with the insulated section, and a sleeve covering at least a portion of the uninsulated section of the conductive wire. In one embodiment the sleeve covers the insulated and uninsulated sections. The sleeve includes a flattened section encasing at least a portion of the uninsulated section and at least one generally tubular section positioned at an end of the flattened section. Apertures may be formed through the flattened section and the conductive wire section.

In one embodiment of the invention, the integral bonding attachment is formed along an unbroken conductive wire. The flattened section encases an unbroken and uninsulated section of the wire. In another embodiment, the integral bonding attachment is used at the end of a wire. In either case, the uninsulated section of the wire is integrally formed with the flattened section that is attached to an attachment surface, such as an electrical ground source.

Another aspect of the invention is a method of forming an integral bonding attachment. The method includes providing a conductive wire having an insulated section and an uninsulated section, and sliding a sleeve over at least a portion of the uninsulated section of the conductive wire. The sleeve is compressed simultaneously with the uninsulated section of wire produce the flattened section while maintaining a tubular section positioned at an end of the flattened section to engage the insulated section of wire. One or more apertures may be formed through the flattened section.

Another embodiment of the invention is an electrical attachment including a conductive wire having an insulated section and an uninsulated section at an interface area. An inner seal is positioned over the conductive wire proximate to the interface area. A metal sleeve covers the inner seal at the interface area and includes a flattened section of the sleeve formed proximate the interface area to capture the inner seal between the metal sleeve and insulation section of the wire to seal the attachment.

DETAILED DESCRIPTION OF THE ILLUSTRATED EMBODIMENTS

The descriptions contained here are meant to be understood in conjunction with the drawings that have been provided.

Figure 1:
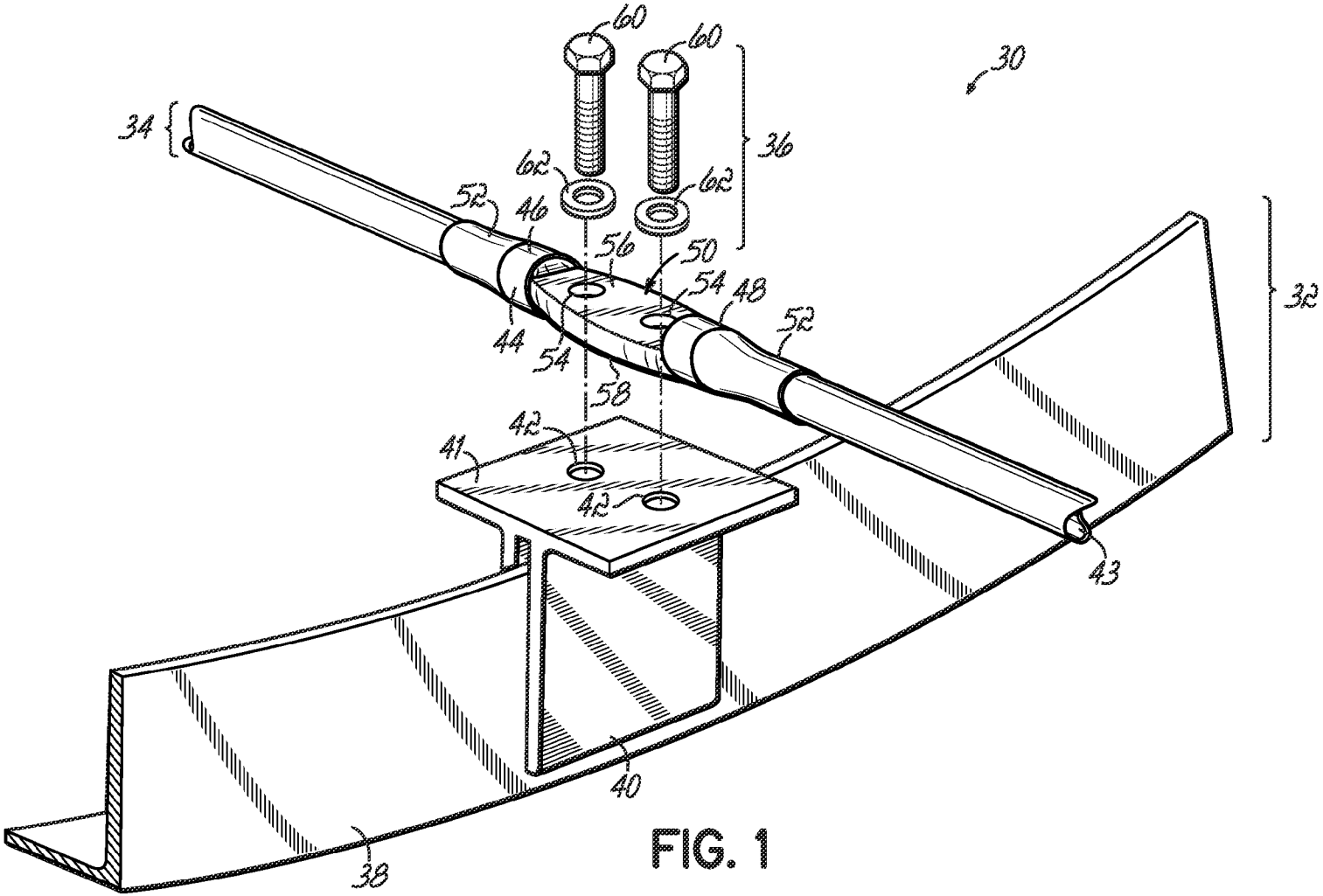
FIG. 1 illustrates a perspective view of an integral bonding attachment according to one embodiment of the invention.

FIG. 1 illustrates an assembly 30 utilizing an embodiment of the invention. The exemplary assembly 30 shown in FIG. 1 generally includes three portions or elements. The first portion is an attachment portion or element 32. The attachment portion 32 is a structure or element or frame with a substantially suitable surface to which the integral bonding attachment 34 of the invention is attached. In one exemplary assembly, the attachment portion has a flat surface to receive the integral bonding attachment 34. The second portion is the integral bonding attachment 34, embodiments of which are disclosed herein. The integral bonding attachment 34 of the invention utilizes includes a portion of a conductive element or conductor, such as a conductive wire or cable 43 and a sleeve or barrel 44. The portion of the wire 43 is shown in FIG. 1, but it will be understood that the overall wire could be significantly longer.

The sleeve 44 includes one or more tubular sections 46, 48, 80 and a planar or flattened section 50, 78 as discussed further hereinbelow. The term "tubular" as used herein means a generally tube-like structure having a longitudinal dimension that is significantly longer than its perpendicular cross-sectional dimension and is not intended to restrict an element to any particular cross-sectional shape or dimension, such as a circular cross-section. In one embodiment, the sleeve initially has a circular cross-section to match the cross-section of a typical wire, but the tubular sleeve is generally intended to include any structure with a significantly longer longitudinal dimension than perpendicular cross sectional dimension.

The third portion of assembly 30 is the fastener assembly 36 which may be any suitable fastener assembly that combines and fixes the other elements together. The integral bonding attachment 34 of the present invention provides a means for coupling a conductive wire or cable to an electrical grounding structure for a robust ground connection.

FIG. 1 illustrates one exemplary attachment portion 32 that is found in an aircraft wing, which is one particular use for the present invention. The attachment structure includes a rib 38 that is a curved piece of metal used in the assembly of a wing of a plane. Of course, in other embodiments, the attachment portion 32 can include a variety of structures that preferably have a suitable surface for attaching the integral bonding attachment 34. For example, the attachment portion 32 may include a bracket 40. The bracket 40 is coupled to the rib 38 reducing motion relative to the rib 38 and providing a suitable flat surface 41. The flat surface 41 has apertures 42 formed therethrough for receiving the fastener assembly 36, which can be modified as to shape, dimension, number, and location to name a few in other embodiments.

The invention may be used with unbroken lengths of wire or a terminal end of a wire. The integral bonding attachment embodiment illustrated in FIGS. 1-6 is directed to an unbroken or uninterrupted conductive wire scenario, while the embodiment of FIGS. 7-11 is directed to the termination end of a conductive wire 43. The conductive wire 43 facilitates the passage of electrical current in the illustrated embodiment, such are for electrical grounding purposes. For example, one use of the present invention is to provide a grounding bus for an aircraft that may be threaded throughout a wing structure and attached at various points in the wing frame. Generally, conductive wire 43 has a metal conductive core 63 that may be solid or stranded or some other construction. A suitable insulation or insulative cover 65 covers the core and may be extruded onto or wrapped around the core 63, as is known in the art. In the illustrated embodiment, the tubular conductive wire 43 is insulated generally along most of its length as is common for a ground wire.

Figure 2:
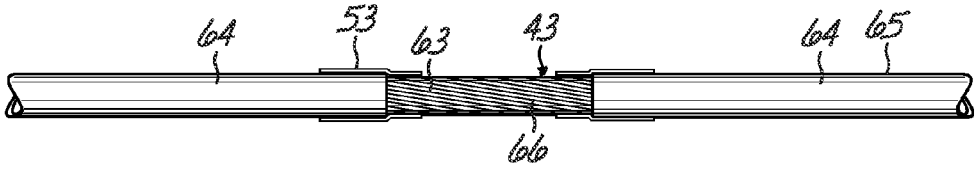
FIG. 2 illustrates a side elevation view of an insulated conductive wire having an exposed section where the insulation has been removed.
Figure 3:
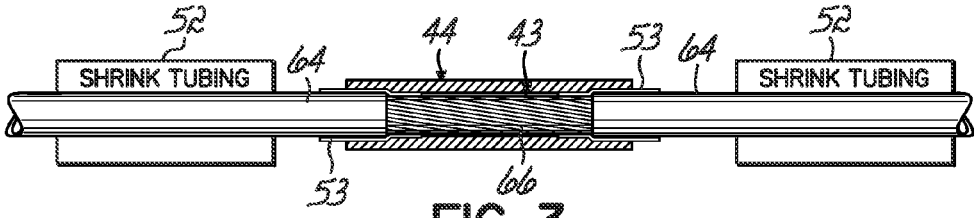
FIG. 3 illustrates a partial cross sectional side elevation view of the conductive wire of FIG. 2 with the addition of a sleeve and two shrink tubes.

Referring now to FIGS. 2-6, the invention incorporates as a component, an exposed or uninsulated section 66 of conductive wire 43 (See FIG. 2). The section 66 may be exposed by stripping or removing the insulation from the wire 43. In accordance with one aspect of the invention, the wire 43 may be coupled or attached to an electrical grounding reference, such as an airplane frame, without cutting the wire to produce an exposed end. The integral bonding attachment 34 also includes a tubular sleeve or barrel 44 configured to cover the exposed or uninsulated section 66 of the conductive wire 43. In one embodiment, the sleeve 44 is formed of a metallic material, such as aluminum, and may be plated with a different metallic material, such as tin. Other embodiments may use other conductive materials. The sleeve may be pre-coated before applying to the wire or may be coated after the flattened section has been formed as discussed further below. The sleeve may be slid onto an end of wire 43 and then slid into place to cover section 66, or the sleeve 44 might be wrapped around or otherwise formed on wire 43. The sleeve initially maintains the tubular shape as shown in FIG. 3 but then is formed to complete the invention as discussed herein. The positioning of the sleeve may be made by aligning the sleeve with preformed markings or other indications (not shown) on the wire or on the insulation of the wire.

Figure 4:
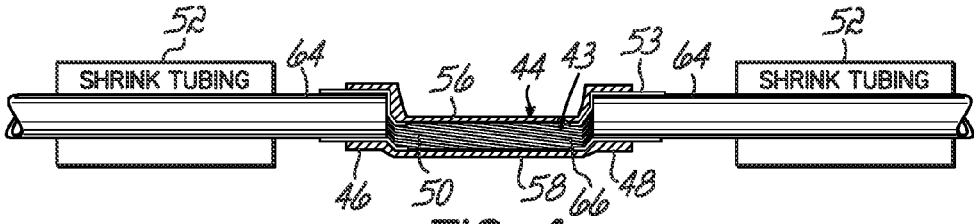
FIG. 4 illustrates a partial cross sectional side elevation view of the conductive wire of FIG. 3 with a section of the sleeve and the uninsulated section of the conductive wire being flattened.
Figure 12:
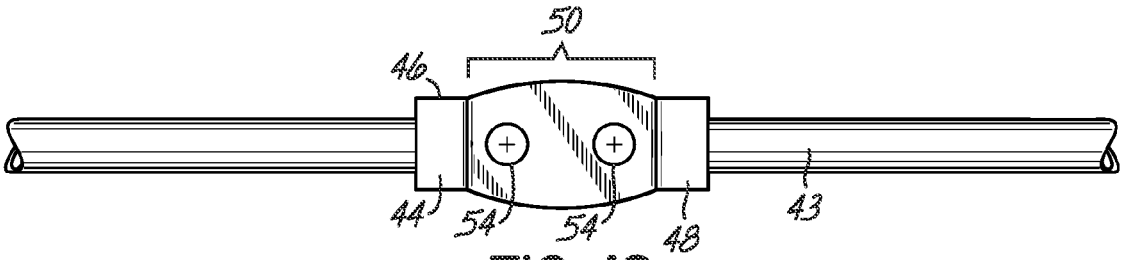
FIG. 12 illustrates a top plan view of the integral bonding attachment of FIG. 1.

When complete, the sleeve 44 includes a flattened section 50 and one or more generally tubular sections or ends 46 and 48 that are not flattened. The flattened section becomes integral with the exposed section 66 of the wire, which also takes a somewhat flattened shape to coincide with section 50. At one or more ends of the flattened section 50 is a tubular section which generally maintains the shape of the sleeve as shown in FIG. 3 prior to forming the flattened section 50. Accordingly, as seen in FIG. 4, the first tubular section 46 and second tubular section 48 provide a transition to the flattened section 50 of the conductive wire 43. The flattened section is configured to encase at least a portion of the exposed or uninsulated section 66 of the wire core 63 while the tubular sections are configured to engage the conductive wire at the ends of the exposed section 66 and to therefore engage the insulation 65. As illustrated in FIG. 12, the exposed section 66 will also be flattened and spread to provide a wider grounding surface for the attachment. In accordance with one aspect of the invention, the flattened section 50 and the exposed core section 66 become a generally unitary structure and the conductive wire 43 becomes an integral part of the integral bonding attachment. This is very different from conventional lugs where the wire just terminates into the lug body and is not integral with the part of the lug actually making the grounding connection. The present invention significantly improves the robustness of the grounding attachment, as well as its electrical and impedance capabilities. In addition, the tubular sections 46 and 48 help to prevent foreign substances from entering into the flattened section 50. The integral bonding attachment 34, and the merged flattened section 50 and core section 66 effectively provide a generally integral conductor at the grounding attachment point.

Figure 5:
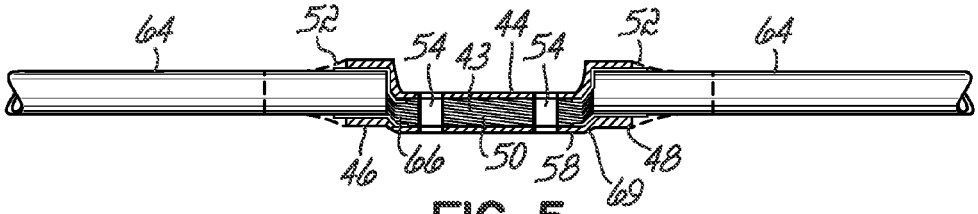
FIG. 5 illustrates a partial cross sectional side elevation view of the conductive wire of FIG. 4 with two apertures formed simultaneously through the flattened section of the sleeve and the conductive wire and the shrink tubes formed to complete the embodiment of the integral bonding attachment illustrated in FIG. 1.
Figure 6:
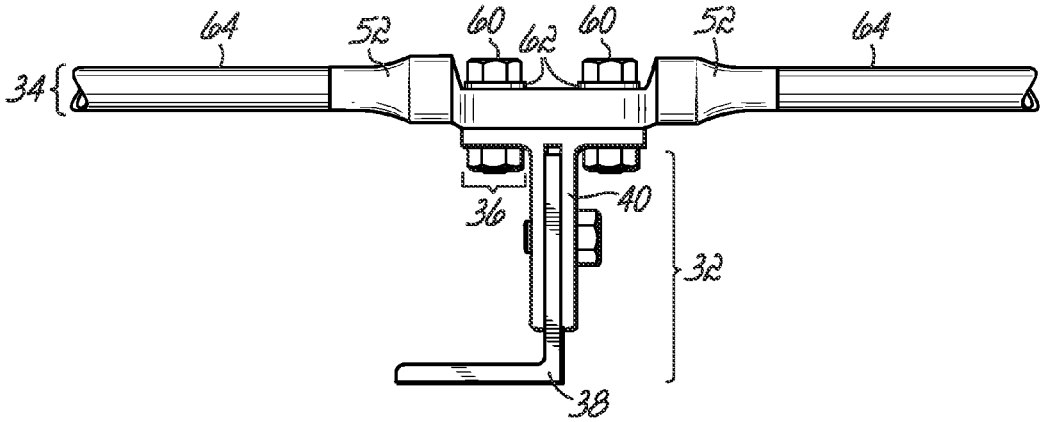
FIG. 6 illustrates a side elevation view of the integral bonding attachment of FIG. 5 being connected to a structure.
Figure 7:
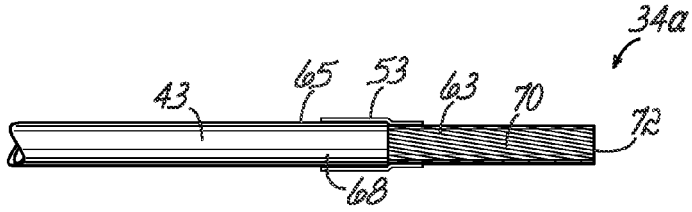
FIG. 7 illustrates a side elevation view of conductive wire having an exposed end section that is not insulated.
Figure 8:
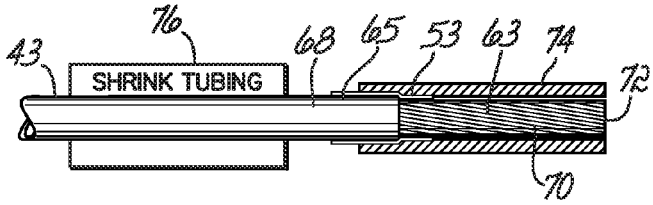
FIG. 8 illustrates a partial cross sectional side elevation view of the conductive wire of FIG. 7 with a sleeve placed around the exposed section of the conductive wire.

In one embodiment, the integral bonding attachment 34 may also include shrink-tubing 52 or other insulating elements that cover the tubular sections 46, 48 of the sleeve 44 and a portion of the insulation 65 of the conductive wire 43. Referring to FIGS. 5 and 6, the shrink-tubing 52 might be commonly formed of a heat shrinking material, however, other materials can be used. The shrink-tubing 52 may be lined with adhesive or may be potted or injection molded. In some embodiments, the shrink-tubing 52 can be made to make a vapor-tight seal and could include pre-etching the PTFE insulation for the shrink-tubing 52 with sealant underneath or for an overmold. The outer sleeve formed by the shrink-tubing as shown in FIGS. 5 and 6 forms a moisture seal for the integral bonding attachment 34 and provides a form of strain relief for the wire/sleeve interface.

The flattened section 50 of the integral bonding attachment 34 also provides the attachment point for coupling the integral bonding attachment to a grounding reference such as a metal frame. Apertures 54 are formed through the flattened section 50 of the sleeve 44 and also through the core section 66 of the flattened section of the wire encased by section 50. The apertures are configured to be able to receive fasteners 60 of fastener assembly 36. Precision drilling forms the apertures 54 in the illustrated embodiment; however, the apertures 54 can be formed in other manners in other embodiments. The flattened section 50 has a first surface 56 that contacts the fastener assembly 36, and a second surface 58, on the opposite side of the flattened section 50, that contacts a lower flat surface 41 of the bracket 40. The first and second surfaces 56, 58 are generally flat, however, in some embodiments the surfaces 56, 58 may possess a slight grade or have undulations. The fastener assembly 36 of the shown embodiment is composed of bolts 60, washers 62, and nuts (not shown). The bolts 60 or fasteners pass through the apertures 54 defined in the flattened section 50 and through the corresponding apertures 42 in the bracket 40. The washers 62 are positioned on the first surface 56 of the flattened section 50 between the bolts 60 and the surface 56. The bolts pass through the apertures 42 and then the nuts (not shown) are screwed onto the ends of the bolts 60 and tightened to firmly affix the integral bonding attachment 34 to the attachment section 32. In that way, the integral bonding attachment of the invention provides a good and robust metal contact to the grounding reference that is transferred directly to the conductive wire 43, a portion of which forms the integral bonding attachment of the invention.

Referring now to FIG. 2 through FIG. 6, the construction of one embodiment of the integral bonding attachment 34 is illustrated. FIG. 2 illustrates that the conductive wire 43 begins with an insulated section 64 that is covered with suitable insulation 65. An unbroken and uninsulated or exposed section 66 is prepared by stripping the insulation from the conductive wire 43 without damaging the core 63 of the conductive wire 43. Suitable methods for safely window stripping the insulation include laser stripping or heated wires. The exposed metal core 63 may be coated or otherwise treated with a corrosion inhibitor at this stage. As shown in FIG. 3, the sleeve 44 is slid or otherwise placed over the unbroken, uninsulated section 66, and is generally centered over section 66. For example, the sleeve might be slit along its length (not shown) and spread apart to be placed over the wire. As noted, positioning of the sleeve may occur using markings or other alignment features on the wire.

The sleeve, at this stage, is generally tubular throughout its length and has not been configured to form the flattened section 50 or the tubular sections 46,48. Preferably, the inner diameter of the sleeve 44 is close to the outer diameter of the insulated conductive wire 43 to provide a somewhat snug fit. In one embodiment, small sleeves of a shrink material 53, such as shrink tubing, might be positioned underneath the sleeve and between the sleeve 44 and the core 63 before the sleeve 44 is finally positioned in order to further seal the core from corrosion and provide an element tight interface at the sleeve ends. The inside sleeves 53 might be shrunk or otherwise sealed over the insulated/uninsulated juncture of the wire before the sleeve is deformed according to the invention. As may be appreciated, such inner sleeves 53 might not be necessary, and might not be used. As shown in FIG. 3, outer seal shrink-tubing 52 might also be placed on or slid over the conductive wire 43 and the sleeve at this stage.

As shown in FIG. 4, a section of the sleeve 44 generally centered over uninsulated section 66 is flattened, such as by a suitable die, to form the flattened section 50 of the sleeve. As shown, the flattened section has a formed generally flat first surface 56 and second surface 58. In one embodiment, the flattening of the sleeve is performed using a die, however, other methods can be used. The conductive core 63 is also flattened and thereby spread out as illustrated by FIGS. 1 and 12 to generally form a wide and integral construction including section 50 and core section 63. However, the core section remains generally continuous and unbroken, although in a stranded construction some strands might be broken. In that way, the core section 63 is part of the construction of the integral bonding attachment 34 at the point of electrical contact, such as with a frame structure. This provides desirable electrical and impedance characteristics at the point of the electrical ground reference. In most embodiments, the solid core or conductive strands comprising the core 63 of the conductive wire 43 are not compromised significantly during the flattening.

In the shown embodiment, the flattened section is formed below the axis of the wire and a slight transition area 69 is provided proximate the bottom surface 58 to provide an offset to the surface 58 so that when the integral bonding attachment is attached to an attachment element 32 or other element, sufficient clearance is provided for the thickness of the wire 43. The offset also accounts for any thickness of the outer shrink-tubing 52. In another embodiment of the invention (not shown), the flattened section might be formed to be generally centered with the axis of the conductive wire. The tubular sections 46, 48 of the sleeve 44 are not flattened in the illustrated embodiment and remain generally tubular to fit over the insulated section 64 of the conductive wire 43. In one embodiment, the tubular sections might also be crimped or formed with a die as desired to shape or reshape them.

FIG. 5 illustrates that the outer shrink-tubing 52 has been positioned over the overlap end area of sleeve 44 and the conductive wire 43 and then heat-shrunk or otherwise formed over the first section 46 and the second section 48 of the sleeve 44 to further seal the sleeve. In addition, the apertures 54 are drilled through the flattened section 50 and core 63 to facilitate insertion of the bolts 60 and other components of the fastener assembly 36. In an alternative embodiment, apertures might not be used and the integral bonding attachment might be otherwise fixed or attached to a grounding structure or frame structure. FIG. 6 illustrates the integral bonding attachment 34 being attached to a suitable attachment portion 32 using the fastener assembly 36. The design improves the flow of current through the conductive wire 43 by maintaining a generally continuous core even in the area in the flattened section 50, notwithstanding areas of the core removed by the apertures 54.

Figure 9:
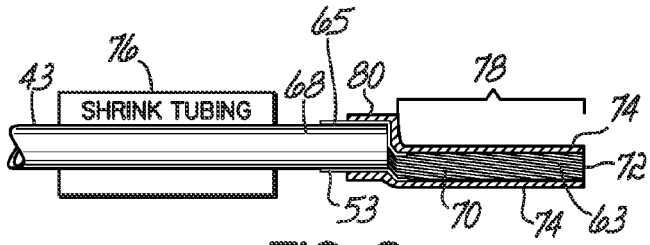
FIG. 9 illustrates a partial cross sectional side elevation view of the conductive wire of FIG. 8 with a portion of the sleeve and the uninsulated section of the conductive wire being flattened.
Figure 10:
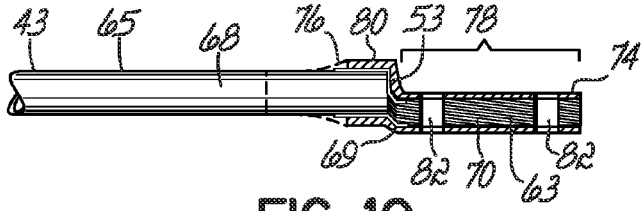
FIG. 10 illustrates a partial cross sectional side elevation view of the conductive wire of FIG. 9 with apertures formed simultaneously through the flattened section of the conductive wire and the sleeve and the shrink tube formed to complete the embodiment of the integral bonding attachment.
Figure 11:
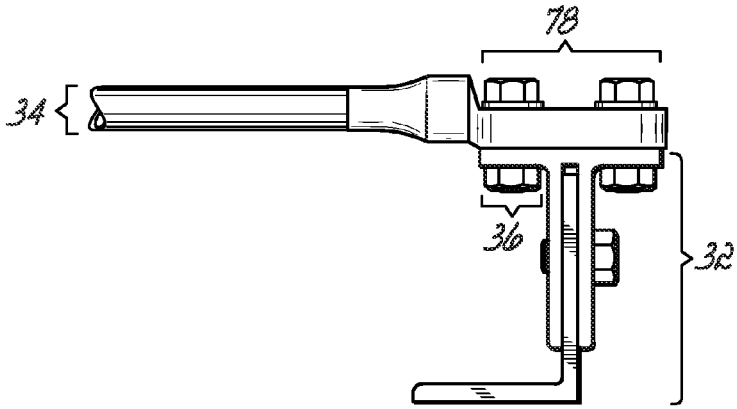
FIG. 11 illustrates a side elevation view of the integral bonding attachment of FIG. 10 connected to a structure.

Referring now to FIG. 7 through FIG. 11, an alternative embodiment is illustrated for terminating an end of a conductive wire 43 and providing the benefits of the integral bonding attachment 34*a* of the invention as set forth herein. The embodiment 34*a* is somewhat similarly constructed as noted above for the embodiment 34. Similar to the design illustrated in FIG. 2 through FIG. 6, the conductive wire 43 includes a conductive core 63 and insulation 65 over the core. For practicing the invention, the end 72 of the wire 43 is appropriately stripped to expose the core forming an insulated section 68 and an exposed or uninsulated section 70. As in the embodiments illustrated in FIGS. 2 through 6, FIG. 8 illustrates a sleeve 74 placed and positioned as noted above over the uninsulated section 70 to encase the exposed wire core of the section 70. Inner sleeves of shrink tubing 53 might be placed under the sleeve 74 at its end that engages the insulation 65 of the cable to provide a tight seal at that juncture. Outer shrink-tubing 76 may also be placed thereon before or after the sleeve in the fashion as noted above. The sleeve 74 and the uninsulated section 70 are flattened, such as with a die, to create the flattened section 78 with the flattened integral core section 63 as illustrated in FIG. 9. The tubular end section 80 of the sleeve 74 generally retains its original structure. Of course, as noted above, the end section might also be further crimped or formed as desired. FIG. 10 illustrates the outer shrink tube 76 shrunk or otherwise formed around the tubular section 80 of the sleeve 74 to seal the integral bonding attachment. Apertures 82 are also formed. Accordingly, the flattened section of the conductive wire core 63 that is encased in the flattened section 78 provides an integral current conductor that may be attached to a grounding reference or an element to be grounded. With the integral bonding attachment 34*a*, an end 72 of the conductive wire 43 may be terminated while enabling robust fastening to the attachment portion 32 for grounding as illustrated in FIG. 11. As noted above, the integral bonding attachment improves the flow of current through the conductive wire 43 by maintaining a generally continuous core and incorporating the core into the sleeve section that is attached to a grounding attachment portion.

Figure 14:
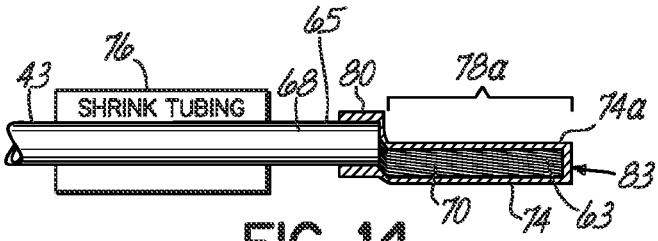
FIG. 14 a partial cross sectional side elevation view of an alternative embodiment of the invention.

In an alternative embodiment of the invention as illustrated in FIG. 14, the end 83 of the sleeve or barrel 74*a* might be closed. In that way, a closed flattened section 78*a* might be formed to prevent corrosion of the integral bonding attachment.

Figure 13:
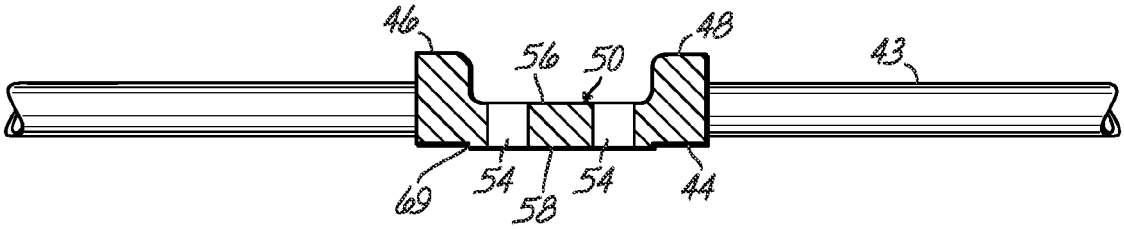
FIG. 13 illustrates a cross-sectional side elevation view of the integral bonding attachment of FIG. 1.

Referring now to FIG. 12, a top plan view of the integral bonding attachment 34 of FIG. 1 is illustrated without the shrink-tubing 52. This view illustrates that the flattened section 50 may be formed to be generally oval-shaped. Those skilled in the art readily recognize that other shapes may be used in other embodiments. The oval-shaped nature of the flattened section 50 and corresponding flattened core 63 increases the area that an electric current can flow through and accordingly the flattened section 50 has more conductivity and lower resistance than the conductive wire 43 in the tubular sections. The sleeve 44 cold flows with the core material 63 in the conductive wire 43 to create a flattened section 50 that is also higher in strength than the other sections of the conductive wire 43. Plus, the outer plating of the sleeve 44 protects the flattened section 50 and core 63 from corrosion. In this embodiment, the flattened section 50 lies generally in the same plane as the conductive wire 43, but other embodiments can bend the flattened section 50, particularly with the design of FIGS. 7-11, to be in other planes. FIG. 13 illustrates the integral bonding attachment 34 of FIG. 1 from a cross-sectional side elevation view without the shrink-tubing 56. This view illustrates that the flattened section 50 provides two substantially flat surfaces 56 and 58 facilitating the operation of the fastening assembly 36 and connection to a flat surface.

Figure 15:
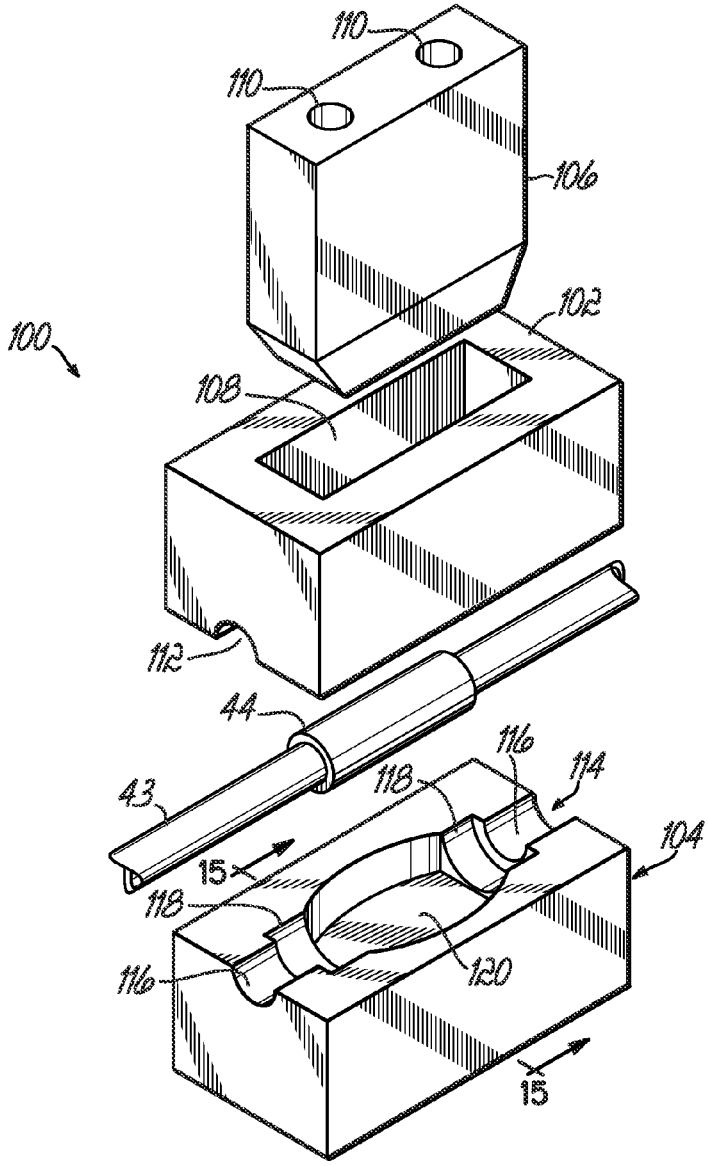
FIG. 15 illustrates an exploded view of a die assembly for forming an embodiment of the present invention.

FIG. 15 illustrates one suitable die assembly 100 for making an embodiment of the present invention. The die assembly includes a top die block 102 and a bottom die block 104. The die blocks 102, 104 are brought together and actively mated to encase a wire 43 and sleeve 44 to make the integral bonding attachment of the present invention. In one embodiment, the active mating involves bringing the blocks together and activating an anvil to press the sleeve and wire. Referring to FIG. 15, the die anvil 106 slides within an appropriate opening 108 that is formed in the top die block. The anvil 106 may include drill guide apertures 110 as illustrated in FIG. 15.

To form the integral bonding attachment of the invention, both the top die block 102 and bottom die block 104 include channels 112, 114 formed therein to receive wire 43 and sleeve 44. The die blocks channels each include sections 116 generally matching the diameter and shape of wire 43. Other sections 118 match the general diameter or shape of sleeve 44. The wire and sleeve illustrated in FIG. 15 each have a circular cross section, although tubular structures having other cross sectional shapes might also be utilized. The bottom die block 104 includes a flattening or stamping area 120 in the channel that coincides with various dimensions of the die anvil 106. When the die assembly is actively mated the die anvil 106 passes through the top die block 102 through the aperture 108 and engages the flattening area 120. When the sleeve is positioned between the die blocks 102, 104, the anvil 106 and flattening area 120 form the flattening section of the integral bonding attachment discussed above. As illustrated in FIG. 15, the flattening area has an oval shape 120 to generally form the shape of the flattened section. However, other shapes might be utilized for the flattening area 120. The flattening area is wider than the cross-sectional dimensions of both the sleeve and wire so that the flattened section may spread out. The sections of sleeve 44 outside of the anvil and flattening area are maintained in a generally non-flattened form-to-form generally tubular sections.

Figure 16:
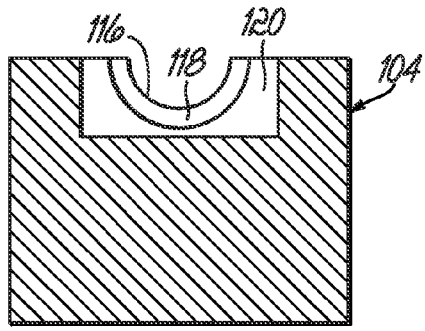
FIG. 16 is a side cross-section of a section of the die assembly along lines 15-15.

FIG. 16 illustrates a cross sectional view of the bottom die block 104 showing the various cross sectional shapes and dimensions of channels 114 which ensure proper formation of the integral bonding attachment and flattened section thereof. The areas 116, 118 ensure that tubular end sections are formed along with the flattened section.

Figure 17:
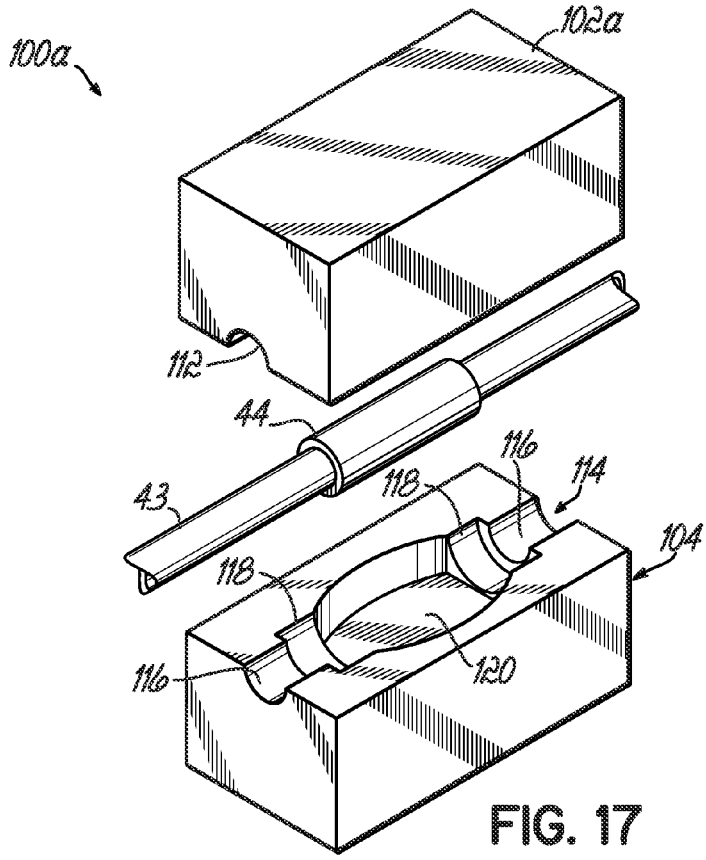
FIG. 17 illustrates an exploded view of an alternative die assembly for forming an embodiment of the present invention.

The alternative embodiment of the die assembly 100 is illustrated in FIG. 17. Therein, die assembly 100*a* utilizes a top die block 102*a* which has an anvil incorporated therein. Therefore, when the die blocks 102, 104 are brought together or actively mated, the integral bonding attachment of the invention is formed. There is no separate anvil movement required.

While the drawings illustrate the die assembly for the embodiment of the invention set forth in FIGS. 2-6, similar die assemblies might be utilized for the embodiment of FIGS. 7-11.

Figure 18:
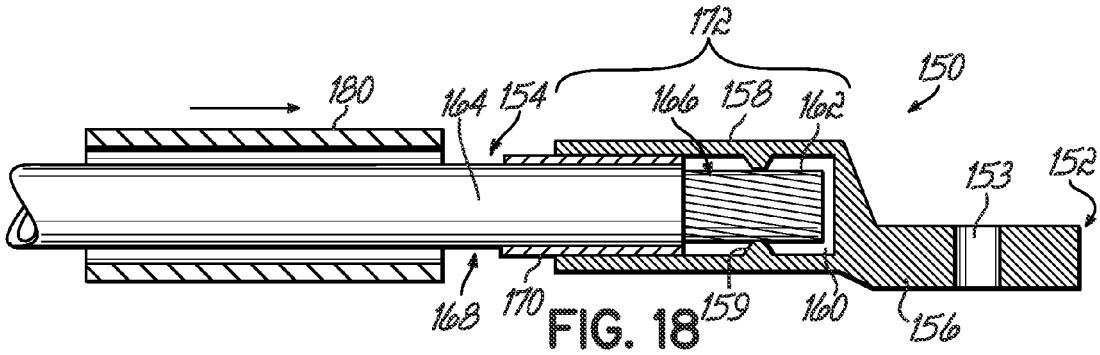
FIG. 18 is a partial cross-sectional side elevation view of an embodiment of an electrical attachment in accordance with one aspect of the invention.

FIG. 18 illustrates an electrical attachment 150 and incorporates aspects of the present invention while utilizing a conventional lug structure 152 coupled to the end of a conductive wire 154. The lug structure 152 may be made of an appropriate conductive material such as metal (e.g. nickel-plated copper) and includes an attachment section or lug section 156 coupled with a sleeve section or sleeve 158. Generally, the lug section 156 and sleeve 158 are integrally formed, but that is not absolutely necessary. Lug section 156 is generally formed to be solid metal whereas the sleeve 158 is tubular and includes a hollow receptacle area 160 to receive the end of a conductive wire 154.

The conductive wire has a conductive core 162 formed of a metal, such as copper or aluminum, for example. Insulation 164 is formed on the outside of the core 162. In one embodiment, the insulation is formed of wrapped layers of PTFE tape, rather than a solid, extruded insulation. For example, 4 to 5 layers of PTFE tape might be wrapped around the conductor and then sintered into a homogenous insulation layer that has great bending properties so that the conductive wire may bend. To utilize the present invention, the conductive wire 154 is stripped of insulation at an end thereof to expose core 162 and form an uninsulated section 166. Correspondingly, an insulated section 168 of the wire 154 remains as part of the rest of the wire length as illustrated in FIG. 18. The lug structure 152 is coupled to the end of wire 154 and may be bolted or otherwise fastened to another conductive surface, such as using a bolt or other fastener (not illustrated) passing through aperture 153.

Figure 19:
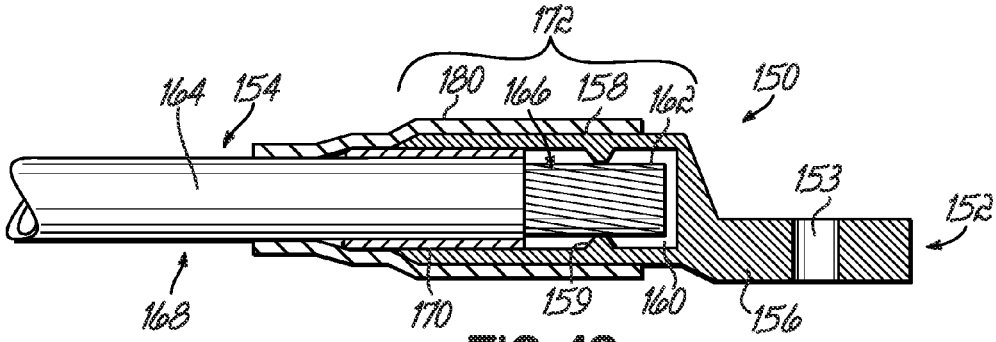
FIG. 19 is cross-sectional view of the embodiment of FIG. 18 showing the sleeve flattened.
Figure 20:
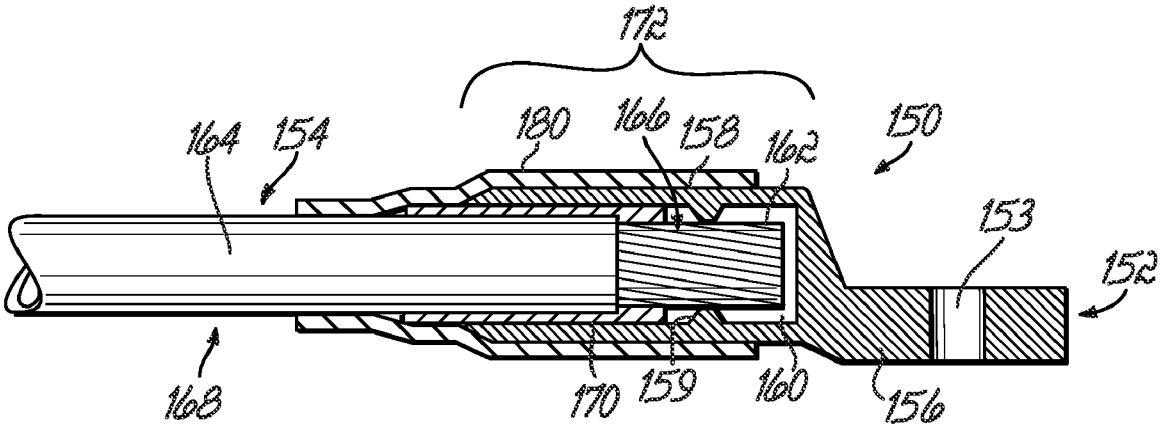
FIG. 20 is a partial cross-sectional side elevation view of an alternative embodiment of an electrical attachment, as shown in FIG. 18.

In accordance with one aspect of the invention, an inner seal is positioned on the conductive wire where it couples with the lug structure 152. Specifically, the transition area between the insulated section 168 and uninsulated section 166 creates an interface area. An inner seal 170 is positioned over the conductive wire 154 proximate the interface area. As illustrated in FIG. 18, the inner seal may only extend over part of the uninsulated section 168. Alternatively, as illustrated in FIG. 20, the inner seal might extend over both the uninsulated and insulated sections of wire 154. The metal sleeve 158 is positioned over the inner seal, and the sleeve is compressed, struck, or otherwise flattened to form a flattened section 172 as illustrated in FIG. 19 to grip the end of the wire 154 and electrically couple the lug structure 152 with the wire 154 as discussed further herein below. The flattened section 172, which is formed proximate the interface area, captures the inner seal 170 between the sleeve 158 and the insulated section of the wire 168 to effectively seal the interface area and thus seal the end of the conductive wire with the lug structure 152 coupled thereto.

Figure 21:
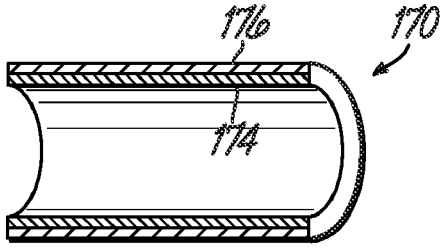
FIG. 21 is a side cross-sectional view of a seal element.

In one embodiment, the inner seal 170 is essentially a tubular seal, which preferably is close in diameter to the cross-section diameter of the wire 154 and its outer insulation. In one embodiment, the inner seal is a plastic seal that includes multiple layers. Particularly referring to FIG. 21, the seal 170 is shown with an inner layer 174 and an outer layer 176. The seal 170 might be formed of a heat-shrinking material to effectively act as a shrink tube around the insulation. For example, prior to attaching the lug structure 152 to the end of wire 154, heat might be applied to thereby shrink tube 170 around the insulation 164 and possibly a portion of the exposed core 162.

For one embodiment of the invention, the inner seal 170 includes at least one layer of a sealing material, such as thermoplastic, elastomer, epoxy or some other suitable material. For example, layer 174 might be a thermoplastic so that the inner layer bonds well with the insulation 164. Conductive wire insulations are sometimes formed of a thermoplastic. Therefore, in making the inner layer 174 of the seal 170 to include a thermoplastic material will provide a good seal of the end of the wire at its connection with a lug structure 152. At least one of the layers, such as outer layer 176, might be formed of a heat-shrinking material such as polyolefin, fluorocarbon, elastomer or cross-linked material, or other suitable material for engaging the sleeve 158 when the inner seal is captured by the sleeve-flattened area 172. Therefore, in accordance with one aspect of the invention, inner seal 170 has an outer layer facing the metal sleeve and an inner layer 174 facing the wire wherein the inner and outer layers are made of different materials for a desirable environmental seal of the connection between the lug structure 152 and wire 154. The sleeve 158 of the lug structure 152 might also include one or more teeth or ridges 159 which grip the exposed core 162 when the sleeve is flattened to form flattened section 172.

In accordance with another aspect of the invention, an outer seal 180 might be utilized to extend over sleeve 158 where it transitions with wire 154 and inner seal 170. Outer seal 180 extends over the end of the sleeve 158 to provide an additional sealing structure to the electrical attachment 150. Outer seal 180 may be made of a heat-shrinking material, such as polyolefin, fluorocarbon, elastomer, or cross-linked material, or other commonly-used material, that may then be shrunk around the sleeve 158 and wire 154 to complete the electrical attachment assembly as illustrated in FIG. 19.

To form the electrical attachments as illustrated in FIGS. 19 and 20, the end of a conductive wire is stripped to expose an uninsulated section and the inner seal is positioned over the conductive wire proximate the interface area between the insulated and uninsulated sections of the wire. The metal sleeve is then positioned to cover the insulated and uninsulated sections of the conductive wire and the inner seal. The sleeve is compressed to form a flattened section proximate the interface area to capture the inner seal between the sleeve and the insulated section of the wire to seal the interface area. Then, outer seal 180 is slid over the wire to cover a portion of the sleeve 158 and is shrunk or otherwise processed to form a seal.

While the FIGS. 18-21 illustrate a tubular seal structure that may be slid over and shrunk around wire 154 to form an inner seal, adhesives might be utilized to adhere the inner seal 170 to wire 154. Alternatively, the inner seal 170 might be potted or injection molded onto the end of wire 154 to form the inner seal. Furthermore, the insulated section 168 of the wire might be pre-etched prior to applying seal 170 for additional sealing properties.

The invention in its broader aspects is not limited to the specific details, representative structure and method, and illustrative examples shown and described. Accordingly, departures may be made from such details without departing from the spirit or scope of the general inventive concept.

What is claimed is:

1. An electrical attachment comprising:

a conductive wire having an insulated section and an uninsulated section of the wire adjacent the insulated section at an interface area;

an inner seal positioned over the conductive wire proximate the interface area;

a metal sleeve covering the insulated and uninsulated sections of the conductive wire and the inner seal at the interface area;

the metal sleeve including a flattened section of the sleeve formed proximate the interface area, the flattened section encasing at least a portion of the uninsulated section of the conductive wire and forming a flattened attachment point with the uninsulated section, the flattened section also capturing the inner seal between the metal sleeve and the uninsulated section and insulated section of the wire to seal the interface area proximate the uninsulated section.

2. The electrical attachment of claim 1 wherein the inner seal is tubular.

3. The electrical attachment of claim 1 wherein the flattened section spans the interface area between the insulated and uninsulated sections.

4. The electrical attachment of claim 1 wherein the inner seal includes at least one layer that includes a thermoplastic.

5. The electrical attachment of claim 4 wherein the layer including a thermoplastic engages the conductive wire when the inner seal is captured by the sleeve flattened area.

6. The electrical attachment of claim 1 wherein the inner seal includes at least one layer that includes a polyolefin.

7. The electrical attachment of claim 6 wherein the layer including a polyolefin engages the sleeve when the inner seal is captured by the sleeve flattened area.

8. The electrical attachment of claim 1 wherein the inner seal has an outer layer facing the metal sleeve and an inner layer, made of a different material than the outer layer, facing the conductive wire.

9. The electrical attachment of claim 8 wherein the outer layer includes a polyolefin and the inner layer includes a thermoplastic.

10. The electrical attachment of claim 1 further comprising an outer seal formed over the part of the metal sleeve and part of the insulated conductive wire.

11. The electrical attachment of claim 10 wherein at least one of the inner seal and outer seal are made of a heat-shrinking material.

12. An integral bonding attachment comprising:

an insulated section of a conductive wire and an uninsulated section of the conductive wire integrally formed with the insulated section at an interface area;

an inner seal positioned over the conductive wire proximate the interface area;

a sleeve covering the insulated and uninsulated sections of the conductive wire and the inner seal;

the sleeve including a flattened section encasing at least a portion of the uninsulated section to form a flattened attachment point with the uninsulated section and also including at least one generally tubular section positioned at an end of the flattened section to engage the insulated section of the conductive wire;

the flattened section capturing the inner seal between the sleeve and the uninsulated section of the conductive wire proximate the interface area to seal the integral bonding attachment with the wire.

13. The integral bonding attachment of claim 12, wherein an aperture is defined through the flattened section and the uninsulated section encased by the flattened section.

14. The integral bonding attachment of claim 12 further comprising an outer seal covering the generally tubular section where it engages the conductive wire.

15. The integral bonding attachment of claim 12, wherein the uninsulated length of conductive wire is located at an end of the conductive wire.

16. The integral bonding attachment of claim 12, wherein the uninsulated length of conductive wire is located internally along the length of the conductive wire for attaching the wire between ends.

17. The integral bonding attachment of claim 12 further comprising generally tubular sections positioned at opposing ends of the flattened section.

18. A method of forming an electrical attachment comprising:

providing a conductive wire having an insulated section and an integral uninsulated section;

positioning an inner seal over the conductive wire proximate an interface area between the insulated and uninsulated sections;

positioning a metal sleeve to cover the insulated and uninsulated sections of the conductive wire and the inner seal;

compressing the sleeve to form a flattened section proximate the interface area to encase at least a portion of the uninsulated section of the conductive wire and to form a flattened attachment point with the uninsulated section, the flattened section also capturing the inner seal between the metal sleeve and the uninsulated section and insulated section of the wire to seal the interface area proximate the uninsulated section.

19. The method of claim 18 wherein flattened section is formed to span the interface area between the insulated and uninsulated sections.

20. The method of claim 18 wherein the inner seal includes at least one layer that includes a thermoplastic.

21. The method of claim 18 wherein the inner seal includes at least one layer that includes a polyolefin.

22. The method of claim 18 wherein the inner seal has an outer layer facing the metal sleeve and an inner layer, made of a different material than the outer layer, facing the conductive wire.

23. The method of claim 18 further comprising positioning an outer seal formed over the part of the metal sleeve and part of the insulated conductive wire.

24. The method of claim 23 wherein at least one of the inner seal and outer seal are made of a heat-shrinking material.

* * * * *

UNITED STATES PATENT AND TRADEMARK OFFICE

CERTIFICATE OF CORRECTION

PATENT NO. : 7,896,712 B2
APPLICATION NO. : 11/613844
DATED : March 1, 2011
INVENTOR(S) : David Charles Cecil et al.

It is certified that error appears in the above-identified patent and that said Letters Patent is hereby corrected as shown below:

In the Specification

Column 1, approximately Line 26, "...as lighting and stray electromagnetic..." should be --as lightning and stray electro-magnetic...--

Column 2, approximately Lines 32-34, "...compressed simultaneously with ... wire produce the flattened section ..." should be --compressed simultaneously with ... wire to produce the flattened section...--

Column 3, approximately Lines 23-24, "FIG. 14 a partial cross sectional side elevation view..." should be --FIG. 14 is a partial cross sectional side elevation view...--

Column 3, approximately Line 35, "...is cross-sectional view" should be --...is a cross-sectional view of...--

Column 3, approximately Line 59, "...invention utilizes includes a portion of" should be --invention includes a portion of...--

Column 4, approximately Line 36, "...such are for electrical grounding purposes." should be --...such as for electrical grounding purposes.--

In the Claims

Column 11, approximately Line 54, "...one of the ... are made of ..." should be --one of the ... is made of...--

Column 12, approximately Line 45, "...wherein flattened section is..." should be --...wherein the flattened section is...--

Column 12, approximately Line 57, "...formed over the part of the metal sleeve" should be --formed over part of the metal sleeve...--

Column 12, last two lines, "...at least one of ... are made of ..." should be --...at least one of ... is made of ...--

Signed and Sealed this
Twenty-fifth Day of June, 2013

Teresa Stanek Rea
*Acting Director of the United States Patent and Trademark Office*